US010314390B2

(12) United States Patent
Waggoner et al.

(10) Patent No.: US 10,314,390 B2
(45) Date of Patent: Jun. 11, 2019

(54) LEG SUPPORTS FOR PORTABLE VOTING BOOTH

(71) Applicant: ELECTION SYSTEMS & SOFTWARE, LLC, Omaha, NE (US)

(72) Inventors: Trevor Waggoner, Lenexa, KS (US); Aaron Dale, Lenexa, KS (US); Steve Beyer, Lenexa, KS (US)

(73) Assignee: ELECTION SYSTEMS & SOFTWARE, LLC, Omaha, NE (US)

( * ) Notice: Subject to any disclaimer, the term of this patent is extended or adjusted under 35 U.S.C. 154(b) by 28 days.

(21) Appl. No.: 15/627,691

(22) Filed: Jun. 20, 2017

(65) Prior Publication Data

US 2018/0360205 A1 Dec. 20, 2018

(51) Int. Cl.
*A47B 3/00* (2006.01)
*A47B 3/10* (2006.01)

(52) U.S. Cl.
CPC ..... *A47B 3/002* (2013.01); *A47B 3/10* (2013.01); *A47B 2200/008* (2013.01)

(58) Field of Classification Search
CPC ..... A47B 3/002; A47B 3/10
USPC ..... 108/34, 131, 124
See application file for complete search history.

(56) References Cited

U.S. PATENT DOCUMENTS 127,484 A * 6/1872 Hirsh ..... A47B 3/0912 108/131
1,576,455 A * 3/1926 Parker ..... A47B 3/0918 108/131
2,086,463 A * 7/1937 Bram ..... A47B 3/0912 108/11
2,282,665 A * 5/1942 McCaslin ..... A47B 3/12 108/34
2,472,962 A * 6/1949 Helsel ..... A47B 3/08 108/131
2,829,019 A * 4/1958 Hoven ..... A47B 3/0911 108/131
2,846,282 A 8/1958 Barker
3,315,621 A * 4/1967 Szymber ..... A47B 3/10 108/132
3,349,728 A * 10/1967 Barecki ..... A47B 3/0912 108/115
3,620,587 A 11/1971 Ahmann
(Continued)

OTHER PUBLICATIONS

Product Catalog, Printelect (21 pgs) [Applicant believes that this information was published before the filing date of the present application.].

(Continued)

*Primary Examiner* — Jose V Chen
(74) *Attorney, Agent, or Firm* — Stinson Leonard Street LLP

(57) ABSTRACT

A portable voting booth that includes a table having a top surface and a bottom surface, a plurality of legs configured to support the table, and a plurality of leg supports attached to the table and configured to stabilize the legs during use of the voting booth. In some embodiments, the leg supports are movable from an open position to a closed position in which the leg supports are immovably secured to the table for storage. Preferably, the leg supports are disengaged from the legs and generally flush with the bottom surface of the table when the leg supports are in the closed storage position.

34 Claims, 15 Drawing Sheets

(56) References Cited

U.S. PATENT DOCUMENTS

| | | | | |
|---|---|---|---|---|
| 4,451,728 | A * | 5/1984 | McKay | G07C 13/00 235/50 R |
| 4,660,904 | A * | 4/1987 | Stephens | A47B 19/08 108/34 |
| 4,662,286 | A | 5/1987 | Barabas et al. | |
| D378,173 | S | 2/1997 | Hobson | |
| 5,666,765 | A | 9/1997 | Sarner et al. | |
| D475,219 | S | 6/2003 | McClure et al. | |
| 6,827,262 | B2 | 12/2004 | McClure et al. | |
| D515,619 | S | 2/2006 | Magee et al. | |
| 7,574,966 | B1 | 8/2009 | Stephens et al. | |
| D599,131 | S | 9/2009 | Brucker et al. | |
| 7,895,954 | B2 | 3/2011 | Abel et al. | |
| 8,006,986 | B1 | 8/2011 | Pazhoor | |
| 8,161,890 | B2 | 4/2012 | Wang | |
| 8,181,582 | B2 | 5/2012 | Abel et al. | |
| 8,308,173 | B2 | 11/2012 | Pazhoor | |
| 8,490,554 | B2 | 7/2013 | Jin | |
| 8,539,887 | B2 | 9/2013 | Pazhoor | |
| 8,651,031 | B1 | 2/2014 | Pazhoor | |
| 2008/0092786 | A1 * | 4/2008 | Chen | A47B 3/08 108/131 |
| 2018/0132606 | A1 * | 5/2018 | Long, Jr. | A45C 13/262 |

OTHER PUBLICATIONS

Website Advertisements, "Voting Booths", ElectionSource, downloaded from the internet on Jul. 11, 2017 at https://www.electionsource.com/voting-booths.html (68 pgs) [Applicant believes that this information was published before the filing date of the present application.].

Website Advertisement, "Pakflatt® Franklin® Voting Booth", inclusion=solutions, downloaded from the internet on Jul. 12, 2017 at http://www.inclusionsolutions.com/election-access/pakflatt-franklin-voting-booth/ (2 pgs) [Applicant beleives that this information was published before the filing date of the present application.].

Website Advertisements for products, Intab, LLC, downloaded from the internet on Jul. 12, 2017 at http://www.intab.net/products.asp?dept=52 (12 pgs) [Applicant believes that this information was published before the filing date of the present application.].

* cited by examiner

LEG SUPPORTS FOR PORTABLE VOTING BOOTH

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates generally to the field of portable voting booths, and more particularly to a portable voting booth that can be used to support a voting machine or to provide a writing surface on which a paper ballot may be hand-marked by a voter.

2. Description of Related Art

Portable voting booths are frequently used at polling locations to provide a private space for voters to cast their ballots in an election. Some portable voting booths have a table that supports a voting machine, such as a direct-recording electronic (DRE) voting machine, which can be used by a voter to electronically cast a ballot. Other portable voting booths have a table that provides a flat writing surface on which a paper ballot may be hand-marked by a voter. When not in use, some portable voting booths are disassembled and stored until the next election. For this reason, it is common for portable voting booths to include removable legs that can be readily attached to the table during use and detached from the table for storage.

A problem with many portable voting booths is that the legs do not adequately support the weight of the table, let alone the added force imposed on the table by the voter during use. Also, some portable voting booths with removable legs are configured such that the legs are not securely held in place and can move about their point of attachment to the table. As a result, many portable voting booths are unstable and can "wobble" when used by a voter. Thus, there is a need for an improved portable voting booth that is stable during use and/or can be disassembled for storage.

BRIEF SUMMARY OF THE INVENTION

The present invention is directed to a portable voting booth that generally includes a table, a plurality of legs configured to support the table, and a plurality of leg supports attached to the table that stabilize the legs during use of the voting booth. In some embodiments, the leg supports are attached to the bottom surface of the table and are movable between an open position in which the leg supports stabilize the legs and a closed position in which the leg supports are secured for storage.

The table of the portable voting booth has a top surface and a bottom surface. In one embodiment, the top surface of the table supports an electronic voting machine. The electronic voting machine may be provided in a carrying case that can be opened and closed, and the lower base of the carrying case when opened functions as the table of the portable voting booth. In another embodiment, the top surface of the table provides a writing surface on which a paper ballot is hand-marked by a voter.

In some embodiments, the legs of the portable voting booth are removably attached to the bottom surface of the table. As such, the legs may be attached to the table during use and detached from the table for storage.

In some embodiments, the leg supports of the portable voting booth are movable to an open position in which the leg supports stabilize the legs during use of the voting booth. In one embodiment, each of the leg supports includes a leg connection portion that engages one of the legs. The leg connection portion may comprise a mouth shaped to receive a portion of the leg and, preferably, the inner surface of the mouth includes an overmolded piece formed from rubber, plastic, thermoplastic elastomer (TPE) or similar materials so as to frictionally grip the portion of the leg received within the mouth.

In some embodiments, the leg supports of the portable voting booth are movable to a closed storage position in which the leg supports are secured to the table in such a manner as to substantially prevent movement of the leg supports in relation to the table. In one embodiment, the table includes fasteners that immovably secure the leg supports to the bottom surface of the table. For example, each of the fasteners may comprise a latch that engages a portion of one of the leg supports. Preferably, the leg supports are disengaged from the legs and are generally flush with the bottom surface of the table when the leg supports are in the closed storage position.

In exemplary embodiments, the portable voting booth includes a table, a plurality of legs removably attached to the bottom surface of the table, and a plurality of leg supports attached to the bottom surface of the table via hinged connections. Each of the leg supports comprises a generally planar triangle-shaped body having first, second and third sides. The first and second sides of each leg support body intersect to form a leg connection portion that engages and stabilizes one of the legs when the leg supports are in the open position. The third side of each leg support body includes at least one leaf having at least one knuckle that interlocks with a pin positioned on the bottom surface of the table so as to provide a hinged connection. To disassemble the portable voting booth, the leg supports are disengaged from the legs, the legs are removed from the table, and the leg supports are moved to the closed storage position. Fasteners positioned on the bottom surface of the table are used to immovably secure the leg supports to the bottom surface of the table. When secured, the legs supports are generally flush with the bottom surface of the table so as to provide a compact unit for storage.

BRIEF DESCRIPTION OF THE DRAWINGS

Various exemplary embodiments of the present invention are described in detail below with reference to the attached drawing figures, wherein.

DETAILED DESCRIPTION OF EXEMPLARY EMBODIMENTS

The present invention is directed to a portable voting booth with leg supports that stabilize the legs during use of the voting booth. While the invention will be described in detail below with reference to various exemplary embodiments, it should be understood that the invention is not limited to the specific structural configurations of these embodiments. In addition, although the exemplary embodiments are described as embodying several different inventive features, one skilled in the art will appreciate that any one of these features could be implemented without the others in accordance with the present invention.

A. First Exemplary Embodiment

Figure 1:
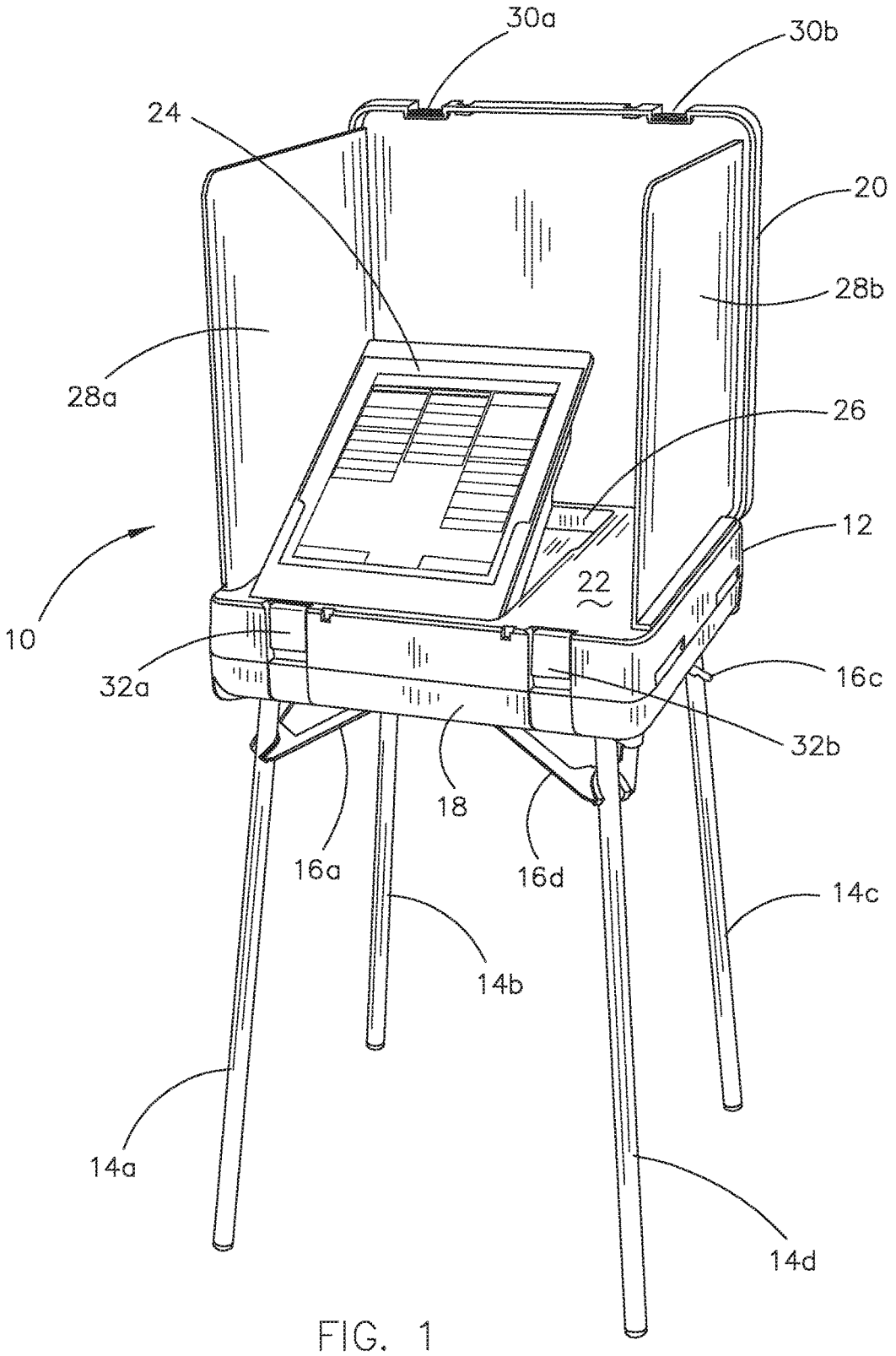
FIG. 1 is a front perspective view of a portable voting booth in accordance with a first exemplary embodiment of the present invention, wherein the portable voting booth includes a carrying case for an electronic voting machine shown in an open position and four legs removably attached to the bottom surface of the carrying case that are stabilized by four leg supports.
Figure 2:
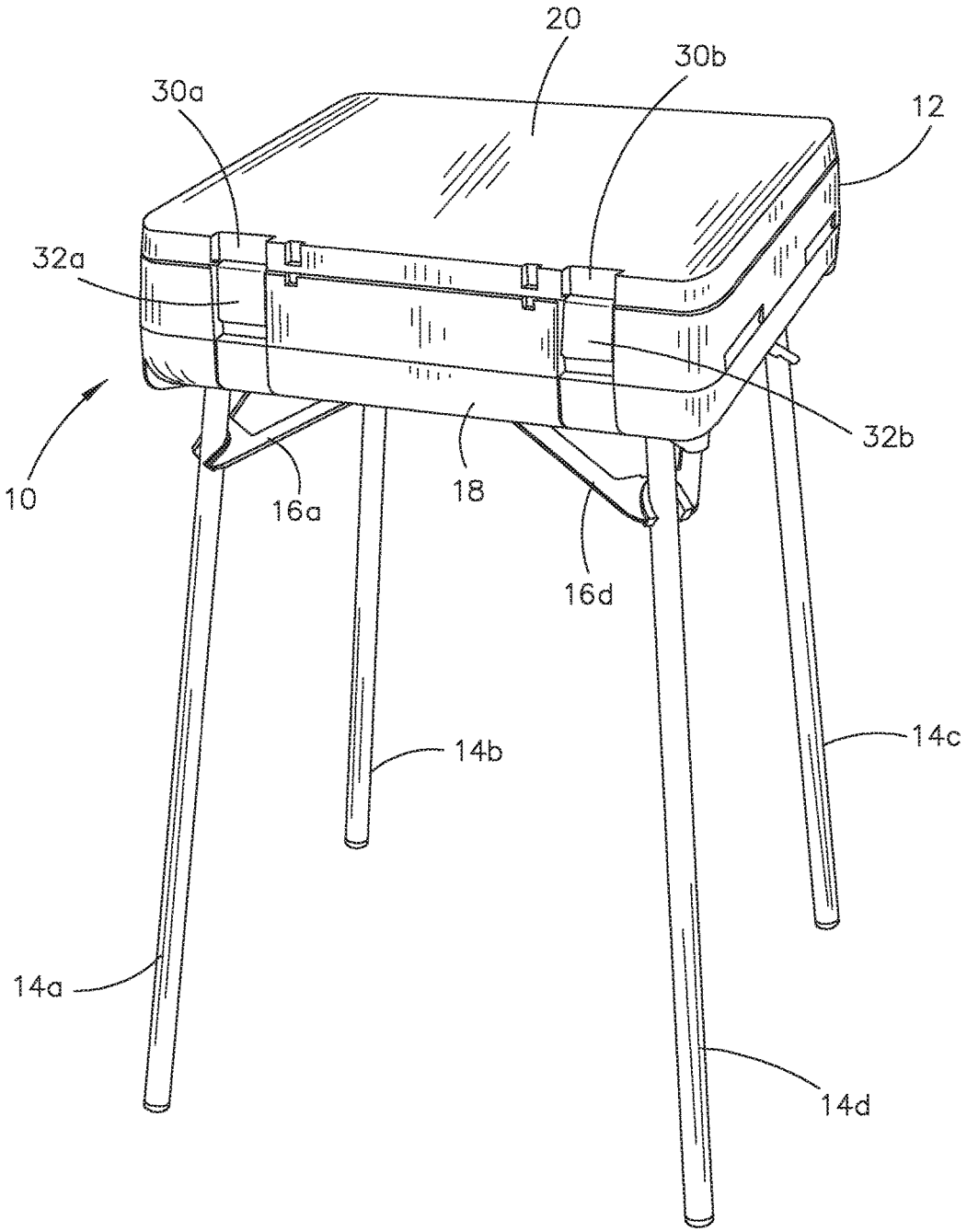
FIG. 2 is a front perspective view of the portable voting booth of FIG. 1 showing the carrying case for the electronic voting machine in a closed position.
Figure 3:
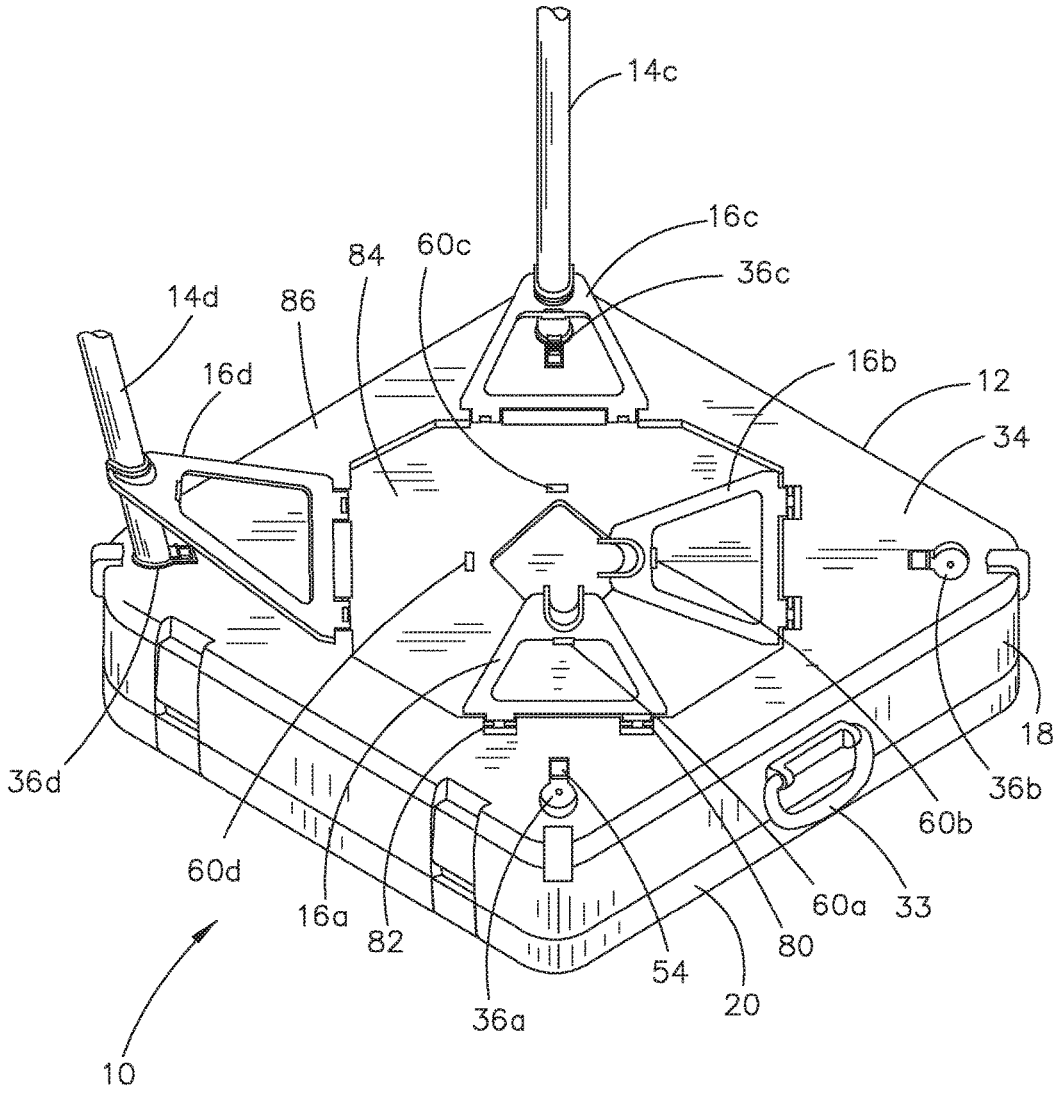
FIG. 3 is a bottom perspective view of the portable voting booth of FIG. 1 showing two of the legs removed from the bottom surface of the carrying case.

Referring to FIGS. 1-3, a portable voting booth in accordance with a first exemplary embodiment of the present invention is shown generally as reference numeral 10. In general terms, portable voting booth 10 includes a carrying case 12 for an electronic voting machine, four removable legs 14*a*, 14*b*, 14*c*, 14*d* that support carrying case 12 during use, and four leg supports 16*a*, 16*b*, 16*c*, 16*d* that are movable between an open position in which the leg supports stabilize legs 14*a*, 14*b*, 14*c*, 14*d*, respectively, during use and a closed position in which the leg supports are secured to the bottom surface of carrying case 12 for storage. Each of these components will be described in detail below.

Carrying Case

Carrying case 12 consists of a lower base 18 and a cover 20 that are attached via a hinged connection so as to permit carrying case 12 to be moved between an open position shown in FIG. 1 and a closed position shown in FIG. 2. When carrying case 12 is in its open position, lower base 18 functions as a table of portable voting booth 10. As such, lower base 18 of carrying case 12 may be referred to as table 18 in describing certain aspects of the present invention. Of course, one skilled in the art will understand that a separate table may be provided in which the carrying case is placed on the upper surface of the table during use. In this embodiment, carrying case 12 is made of a plastic such as a polycarbonate/acrylonitrile-butadiene-styrene (PC/ABS) thermoplastic, although other materials may be used within the scope of the present invention.

As shown in FIG. 1, table 18 has a top surface 22 that is configured to support an electronic voting machine, such as direct-recording electronic (DRE) voting machine 24. As is known in the art, DRE voting machine 24 may be used by voters to electronically cast their ballots in an election. As can be seen, top surface 22 includes a recess 26 that is complimentary in size and shape to DRE voting machine 24. As shown, DRE voting machine 24 is positioned at an angle with top surface 22, but is movable into a horizontal position by placing DRE voting machine 24 within recess 26. Of course, other types of voting machines may also be supported by table 18 within the scope of the present invention.

Preferably, portable voting booth 10 includes a left privacy screen 28*a* and a right privacy screen 28*b* that are positioned in generally parallel vertical planes. Privacy screens 28*a*, 28*b* together with cover 20 provide privacy when voters cast their ballots in an election. Privacy screens 28*a*, 28*b* may be attached along at least a portion of their bottom edges to top surface 22 of table 18 and may be attached along at least a portion of their rear edges to cover 20. In this embodiment, privacy screens 28*a*, 28*b* are attached to top surface 22 of table 18 and to cover 20 via the use of Velcro® brand tape strips. Of course, other types of temporary or permanent attachment means may also be used. Privacy screens 28*a*, 28*b* may also be modified to comply with the Americans with Disabilities Act (ADA) by the addition of privacy screen extensions (not shown), as is well known in the art.

In order to move carrying case 12 from the open position shown in FIG. 1 to the closed position shown in FIG. 2, DRE voting machine 24 is moved from the angled position shown in FIG. 1 to a horizontal position by placing DRE voting machine 24 within recess 26. Privacy screens 28*a*, 28*b* are then detached from cover 20 and folded into a position that is flush with top surface 22 of table 18. Alternatively, privacy screens 28*a*, 28*b* may be completely removed from carrying case 12. Cover 20 is then lowered onto table 18 whereby latches 32*a*, 32*b* on table 18 engage with respective catches 30*a*, 30*b* on cover 20 in order to lock carrying case 12 in the closed position. At this point, DRE voting machine 24 is completely enclosed within and protected by carrying case 12. Of course, one skilled in the art will appreciate that carrying case 12 may be moved from the closed position shown in FIG. 2 to the open position shown in FIG. 1 by simply reversing the steps discussed above.

Referring to FIG. 3, carrying case 12 includes a handle 33 that can be grabbed by a user to enable transport of carrying case 12 with DRE voting machine 24 enclosed therein to a storage location. Of course, DRE voting machine 24 could alternatively be stored separately from carrying case 12 within the scope of the present invention.

Legs

Referring to FIG. 3, portable voting booth 10 includes four legs 14*a*, 14*b*, 14*c*, 14*d* that are configured for attachment into four female connectors 36*a*, 36*b*, 36*c*, 36*d*, respectively, positioned on a bottom surface 34 of table 18. Female connectors 36*a*, 36*b*, 36*c*, 36*d* are each positioned generally equidistant from the center of bottom surface 34 near the corners of table 18, as shown. The configuration of leg 14*a* and its attachment to female connector 36*a* will now be described with reference to FIGS. 4A-D and FIG. 5 (which provides an enlarged view of female connector 36*a*). Of course, it should be understood that legs 14*b*, 14*c*, 14*d* have the same configuration as leg 14*a* and female connectors 36*b*, 36*c*, 36*d* have the same configuration as female connector 36*a* and, as such, these components will not be separately described.

Figure 4A:
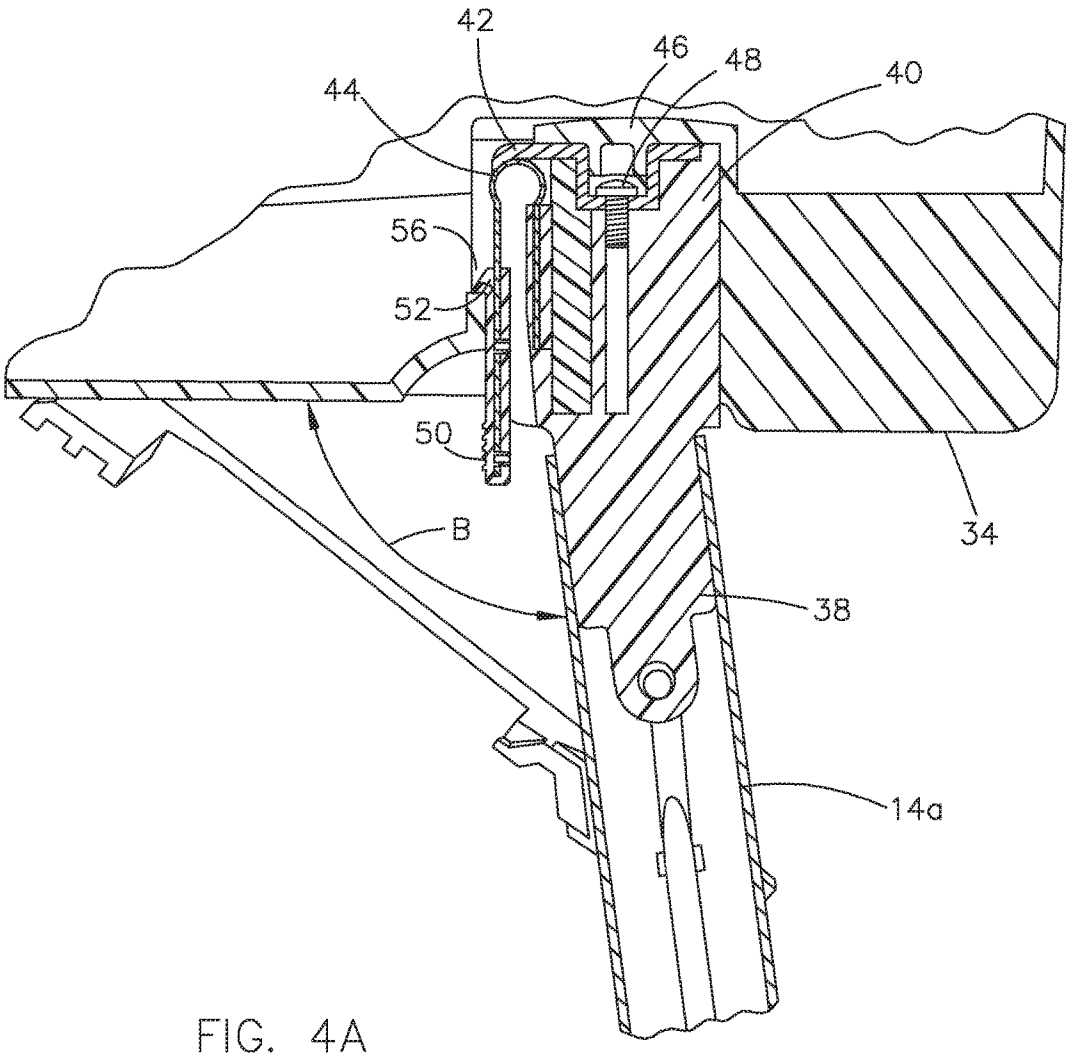
FIG. 4A is a partial cross-sectional side view of the portable voting booth of FIG. 1 showing one of the removable legs attached to the bottom surface of the carrying case.
Figure 4B:
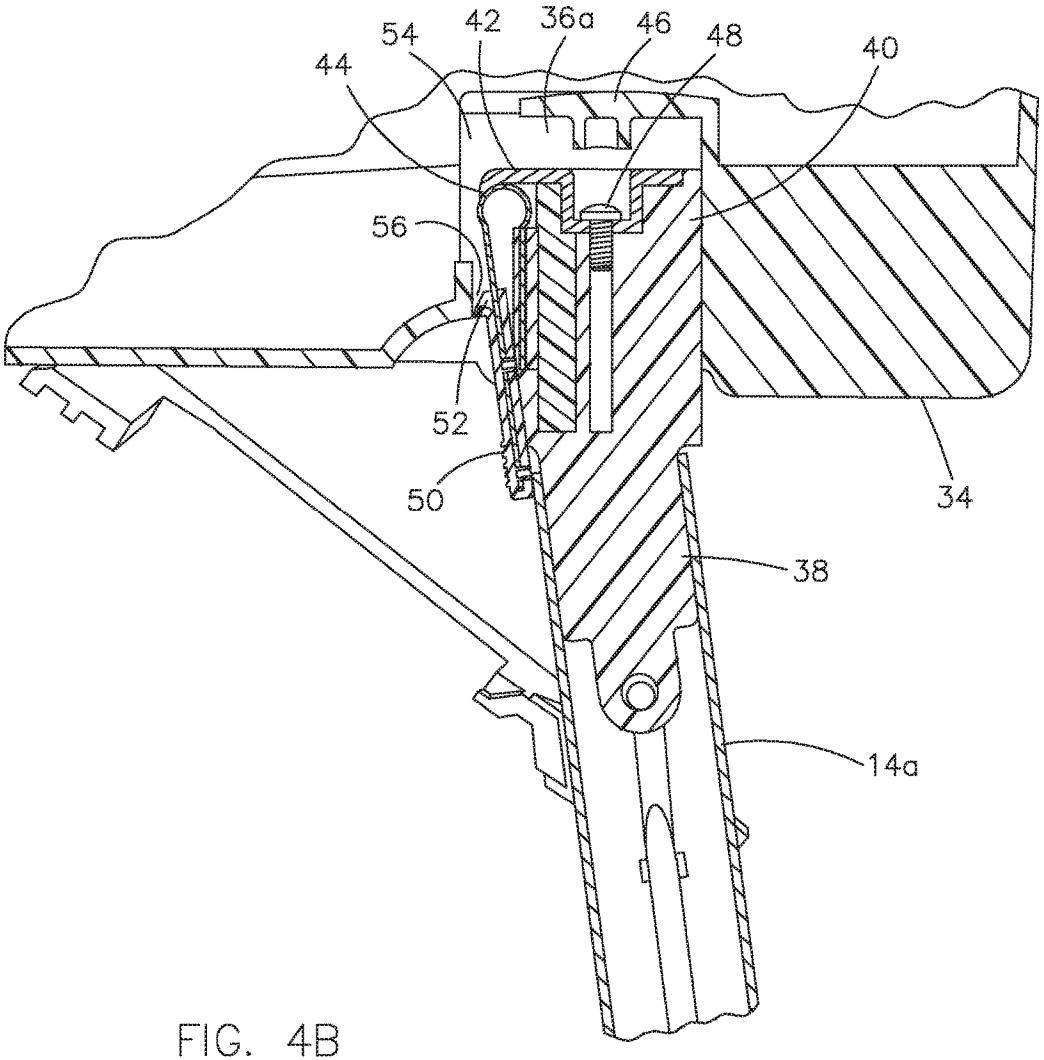
FIG. 4B is a partial cross-sectional side view of the portable voting booth of FIG. 1 showing one of the removable legs detached and partially removed from the bottom surface of the carrying case.
Figure 4C:
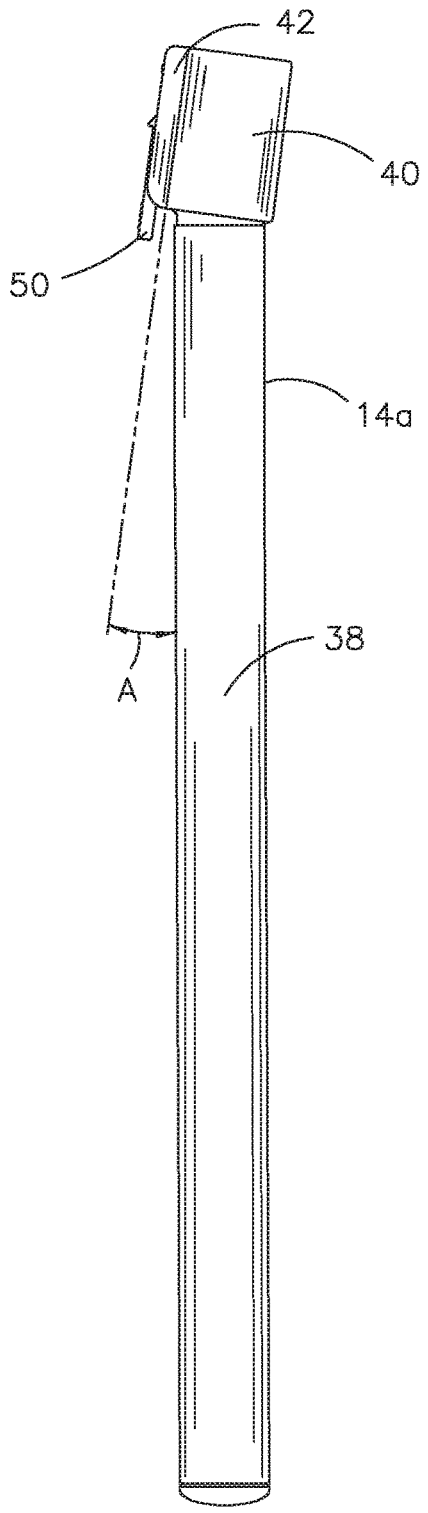
FIG. 4C is a side plan view of one of the removable legs of the portable voting booth of FIG. 1.
Figure 4D:
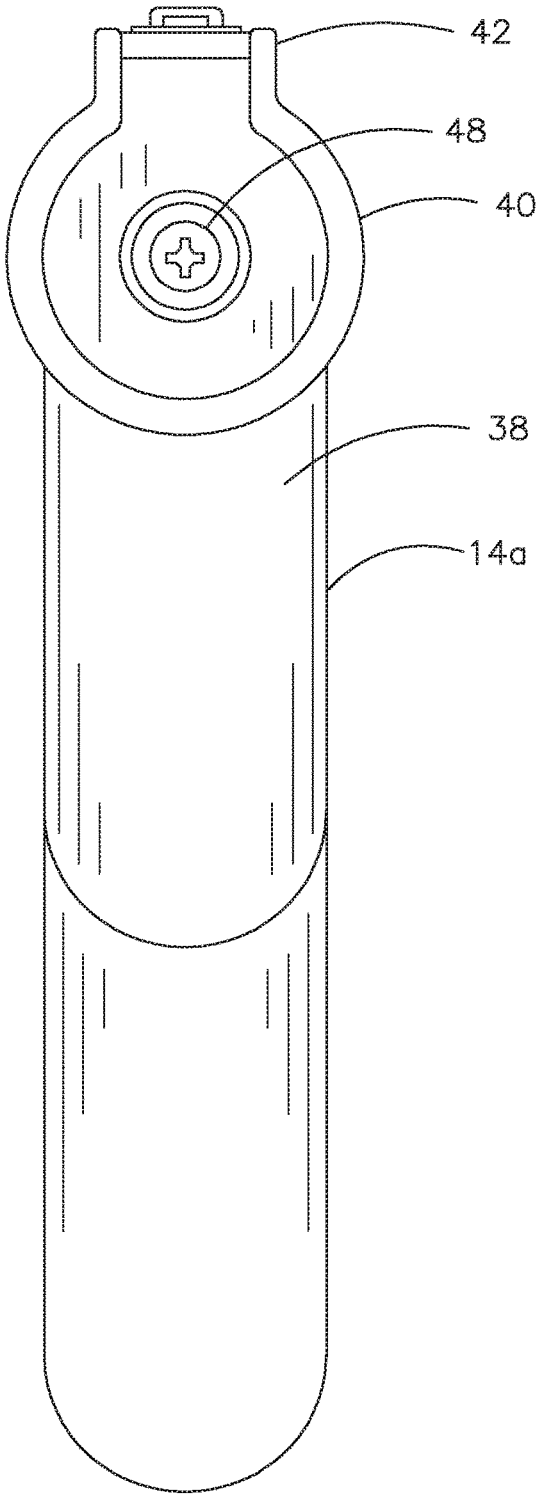
FIG. 4D is a perspective top view of one of the removable legs of the portable voting booth of FIG. 1.
Figure 5:
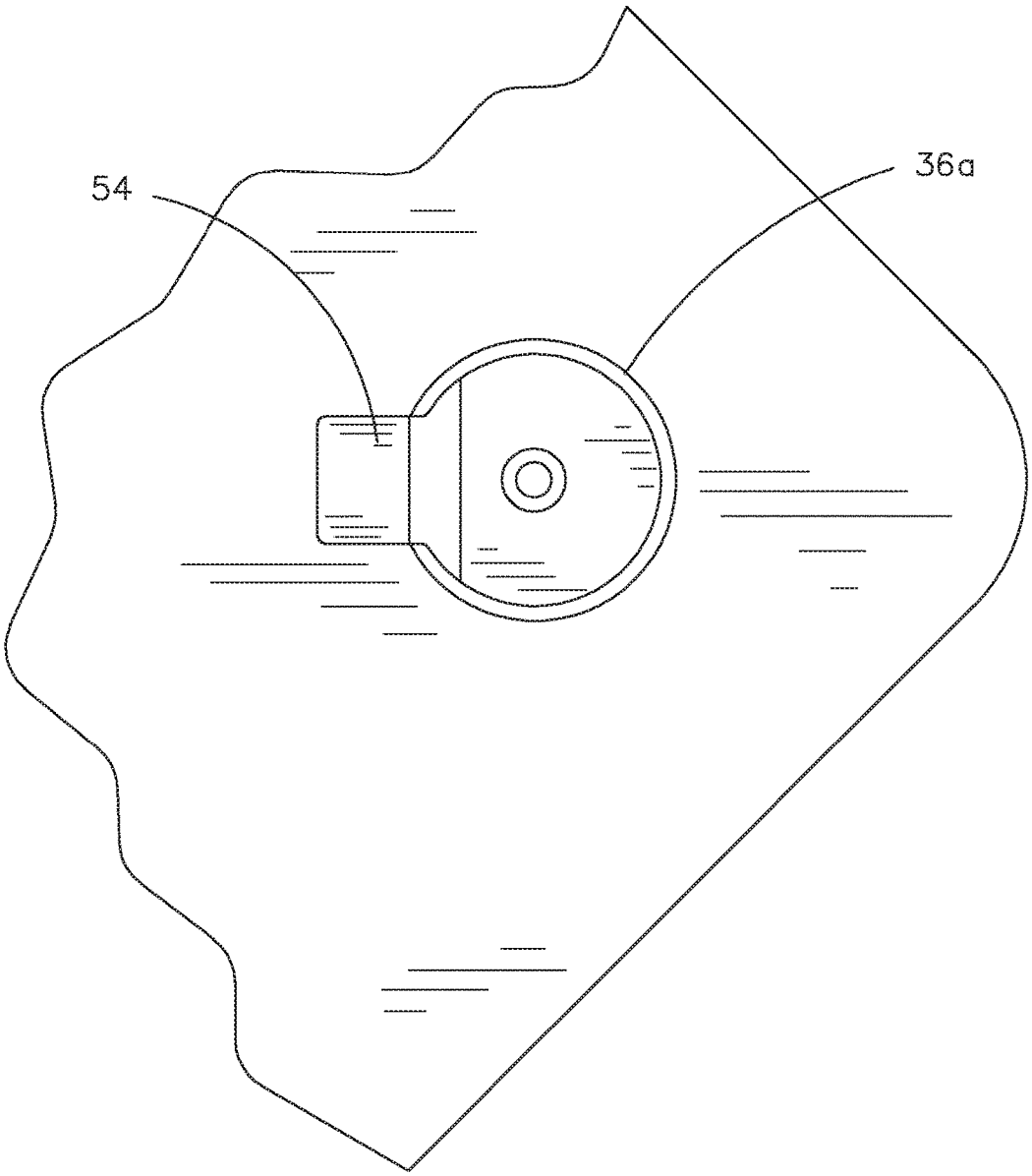
FIG. 5 is a partial bottom plan view of the portable voting booth of FIG. 1 showing a female connector positioned on the bottom surface of the carrying case with its corresponding leg removed.

Referring to FIGS. 4C and 4D, removable leg 14*a* includes a tubular leg portion 38 made from a metal such as aluminum, although other materials may be used within the scope of the present invention. Positioned on the upper end of leg portion 38 is a generally cylindrical male connector 40. Male connector 44 includes a keyed tab 42 and, as best shown in FIGS. 4A and 4B, a spring clip 44 that is aligned with keyed tab 42. Spring clip 44 is positioned within a recess (not shown) in male connector 40 and is held within the recess by a cap 46. Cap 46 is fastened to male connector 40 with a screw 48 (also shown in FIG. 4D). Spring clip 42 is secured to a grip 50 (also shown in FIG. 4C) that slides over the bottom of spring clip 42. Grip 50 has a locking edge or latch 52, which will be described in greater detail below.

Referring to FIG. 4B, female connector 36*a* is positioned on bottom surface 34 of table 18 and includes a keyed slot 54 (also shown in FIG. 5) that has a locking edge or catch 56. As best shown in FIG. 3, keyed slot 54 is aligned with an imaginary line that extends diagonally across bottom surface 34 of table 18 between female connector 36*a* and female connector 36*c*. Referring back to FIG. 4B, male connector 40 and female connector 36*a* are configured to be joined in a specific alignment. Prior to the attachment of removable leg 14*a* to table 18, keyed tab 42 of male connector 40 is aligned with keyed slot 54 of female connector 36*a* so that keyed tab 42 may be received within keyed slot 54. As male connector 40 of leg 14*a* is inserted into female connector 36*a*, the sloped leading end of latch 52 contacts a side wall 58 of keyed slot 54, which causes spring clip 44 to compress. This causes movement of grip 50 and spring clip 44 away from side wall 58 and toward leg portion 38 of leg 14*a*. Once male connector 40 is fully inserted within female connector 36*a* and latch 52 of grip 50 has moved past catch 56 of keyed slot 54, spring clip 44 decompresses. This causes movement of grip 50 and spring clip 44 toward side wall 58 and into the position shown in FIG. 4A. Latch 52 of grip 50 and catch 56 of keyed slot 54 are then interlocked, which results in the attachment of leg 14*a* to bottom surface 34 of table 18.

As best shown in FIG. 4C, when removable leg 14*a* is attached to bottom surface 34 of table 18, leg portion 38 is at an angle A of about 7.5 degrees with respect to male connector 40 as measured between keyed tab 42 and leg portion 38. As best shown in FIG. 4A, this angled orientation results in leg portion 38 being at an angle B of about 97.5 degrees with respect to bottom surface 34 of table 18. Of course, it should be understood that the present invention is not limited to these particular angles of orientation. In other embodiments, the angle between leg portion 38 and male connector 40 may be in the range of 0 degrees to 45 degrees, and the angle between leg portion 38 and bottom surface 34 of table 18 may be in the range of 90 degrees to 135 degrees.

Leg 14*a* can readily be decoupled and removed from bottom surface 34 of table 18 by compressing spring clip 44 via the application of force to grip 50, which moves grip 50 and spring clip 44 away from side wall 58 and toward leg portion 38 of leg 14*a*. At this point, latch 52 of grip 50 and catch 56 of keyed slot 54 are no longer interlocked, thereby reversing the steps described above in connection with the attachment of leg 14*a* to bottom surface 34 of table 18. When leg 14*a* is decoupled and removed from bottom surface 34 of table 18 (as well as legs 14*b*, 14*c*, 14*d* through the same process), the legs can be stored along with carrying case 12 until needed for use in another election.

It should be understood that the present invention is not limited to the use of removable legs that are attached to the bottom surface of the table as described in connection with the first exemplary embodiment. In some embodiments, the legs may be attached using other types of attachment means known in the art, e.g., the legs may be screwed into the table, the legs may twist and lock-in with friction fittings, or the legs may be attached using bungee cords through the center. In other embodiments, the removable legs may be attached to another portion of the portable voting booth. For example, the legs could be attached to the sides of the table rather than its bottom surface.

In yet other embodiments, the legs of the portable voting booth need not be removable, e.g., the legs may be permanently attached to the table. In some embodiments in which the legs are permanently attached to the table, the legs are movable to a storage position in order to save space. For example, the legs could be foldable (e.g., via attachment to the table with hinges) and/or the legs could be telescoping so as to collapse to a storage position. Thus, a number of different leg configurations and attachment means may be used within the scope of the present invention.

Leg Supports

Referring to FIG. 3, portable voting booth 10 includes four leg supports 16*a*, 16*b*, 16*c*, 16*d* each of which is attached via a hinged connection to bottom surface 34 of table 18. Leg supports 16*a*, 16*b*, 16*c*, 16*d* are each positioned generally equidistant from the center of bottom surface 34, as shown. Each of leg supports 16*a*, 16*b*, 16*c*, 16*d* is movable between an open position in which the leg supports stabilize legs 14*a*, 14*b*, 14*c*, 14*d*, respectively, and a closed position in which the leg supports are secured for storage. In FIG. 3, leg supports 16*c* and 16*d* are shown in the open position, while leg supports 16*a* and 16*b* are shown in the closed storage position. Leg supports 16*a*, 16*b*, 16*c*, 16*d* are immovably secured to bottom surface 34 of table 18 when in the closed storage position through the use of fasteners 60*a*, 60*b*, 60*c*, 60*d*, respectively, as described below. The configuration of leg support 16*a* and its attachment to bottom surface 34 of table 18 via fastener 60*a* will now be described with reference to FIGS. 6-10. Of course, it should be understood that leg supports 16*b*, 16*c*, 16*d* have the same configuration as leg support 16*a* and fasteners 60*b*, 60*c*, 60*d* have the same configuration as fastener 60*a* and, as such, these components will not be separately described.

Figure 10:
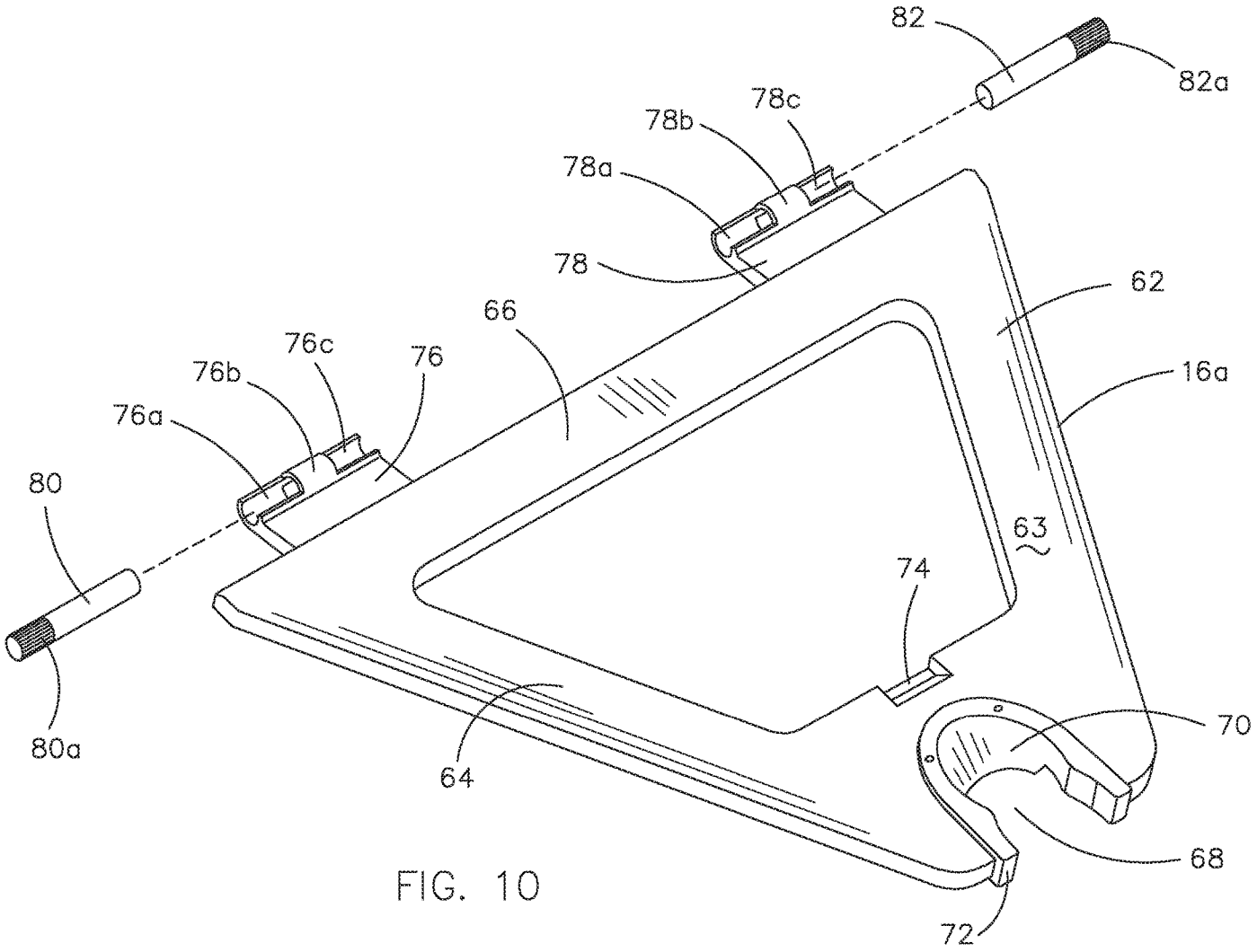
FIG. 10 is an exploded view of one of the leg supports and its corresponding hinge pins of the portable voting booth of FIG. 1.

Referring to FIG. 10, leg support 16*a* has a generally planar triangle-shaped body that includes a first side 62, a second side 64, and a third side 66. The leg support body also has a top surface 63 (also shown in FIGS. 6 and 7) and a bottom surface 65 (shown in FIG. 8). Leg support 16*a* is formed as a single, unitary piece and is made from a plastic such as a polycarbonate (PC) that is preferably impregnated with a stiffener such as fiberglass. Of course, leg support 16*a* may be comprised of different components that are connected together through any suitable means and/or may be made from other materials within the scope of the present invention.

Figure 6:
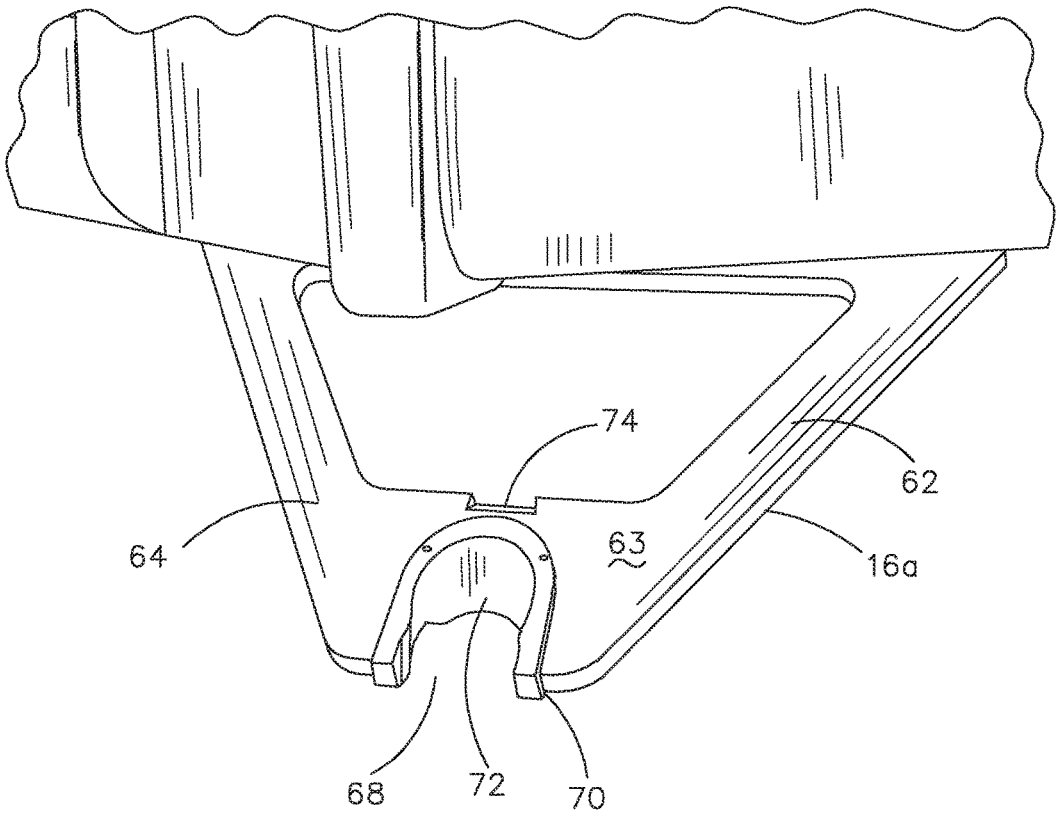
FIG. 6 is a partial front perspective view of the portable voting booth of FIG. 1 showing one of the leg supports in the open position with its corresponding leg removed.
Figure 7:
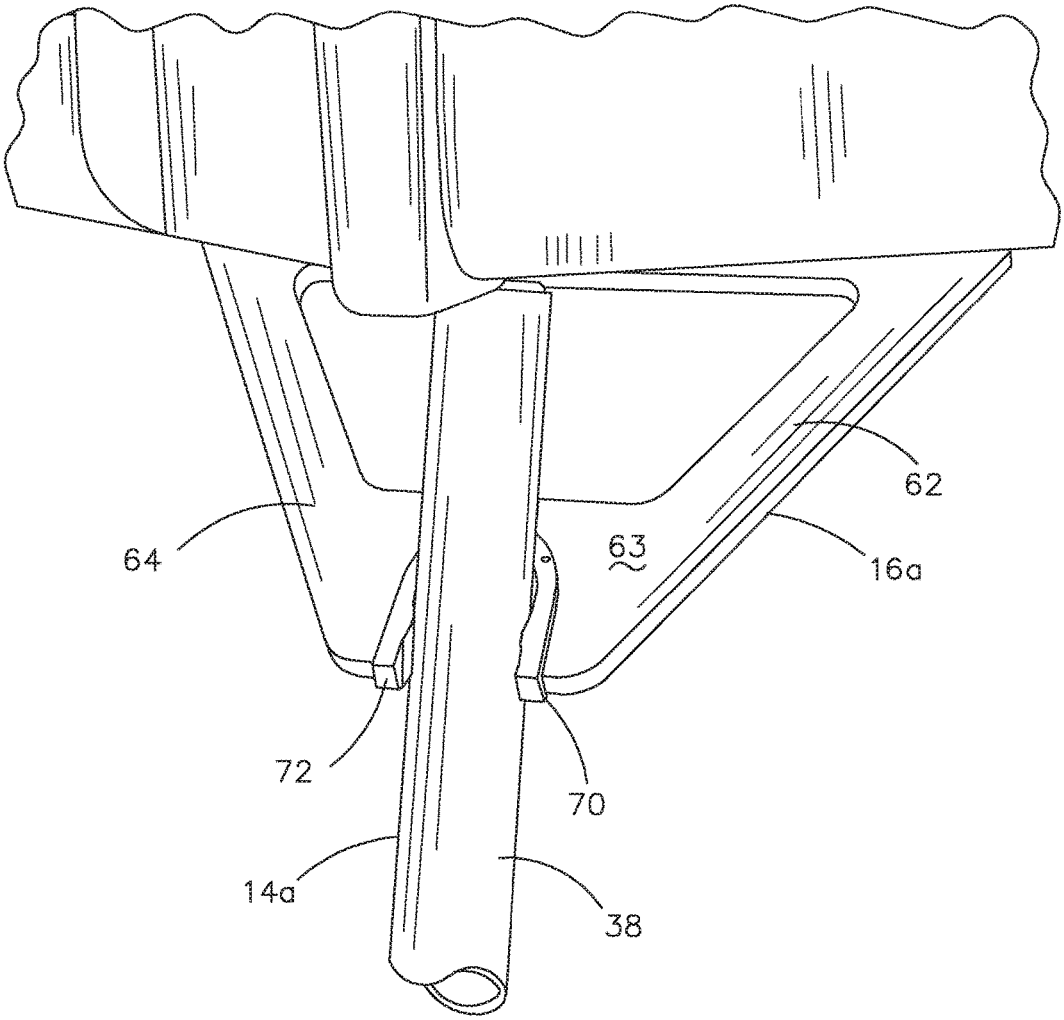
FIG. 7 is a partial front perspective view of the portable voting booth of FIG. 1 showing one of the leg supports in the open position and engaging its corresponding leg.
Figure 8:
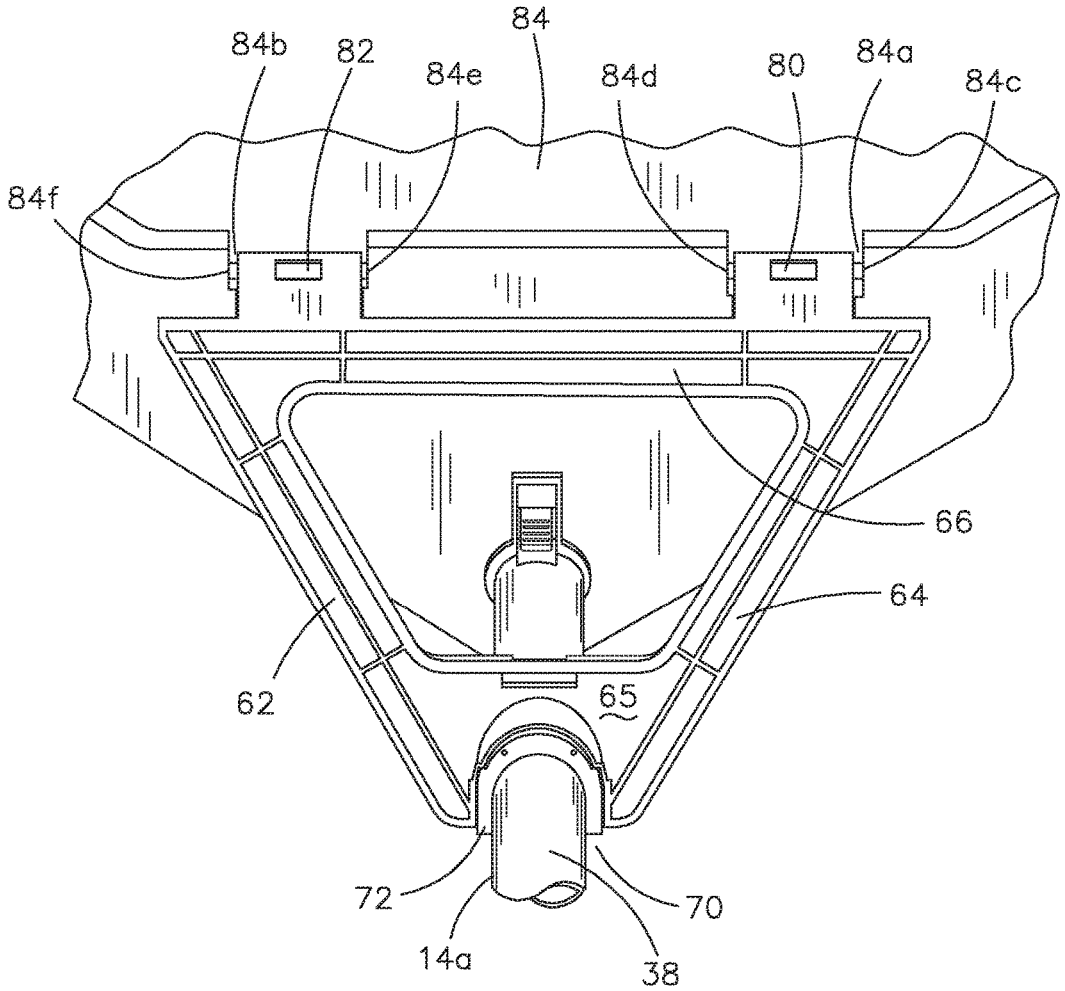
FIG. 8 is a partial bottom perspective view of the portable voting booth of FIG. 1 showing one of the leg supports in the open position and engaging its corresponding leg.
Figure 9:
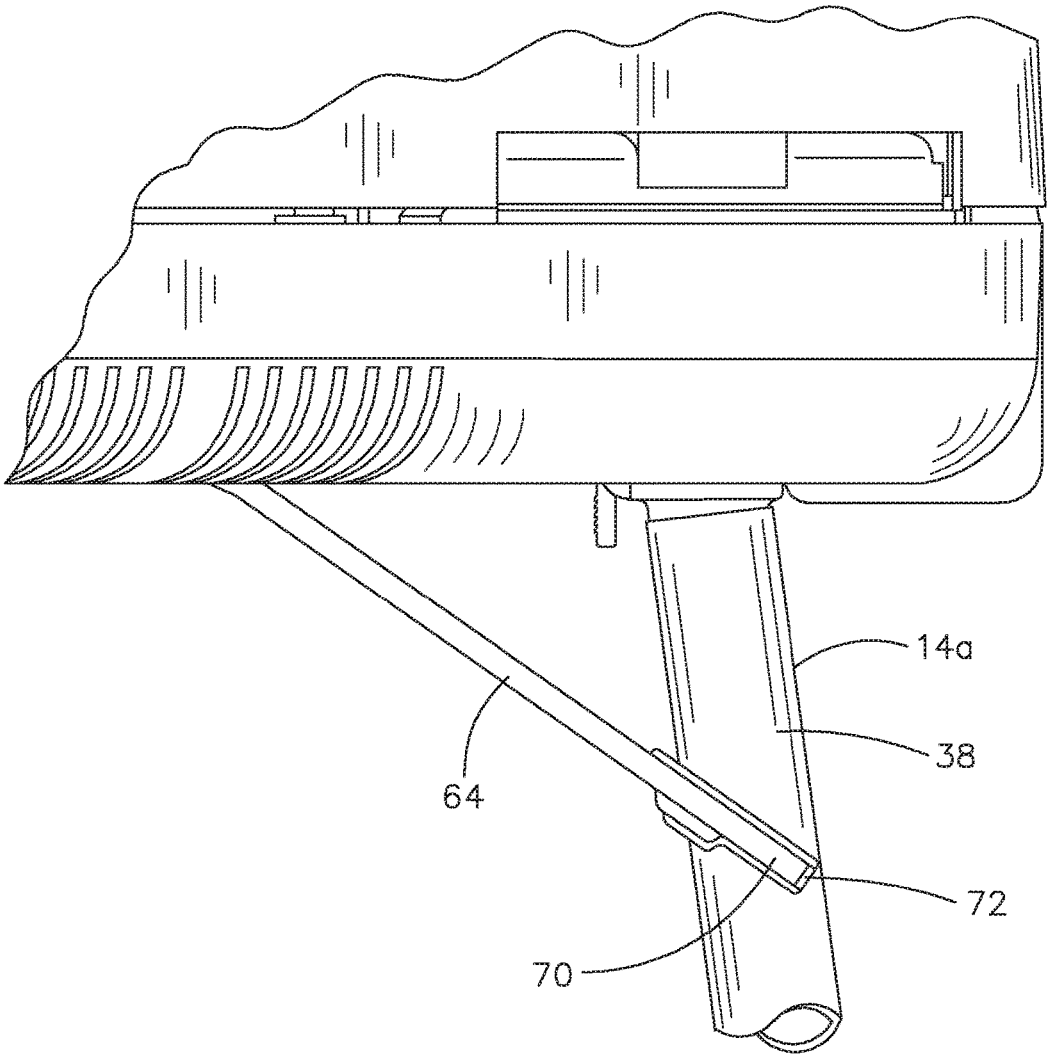
FIG. 9 is a partial side plan view of the portable voting booth of FIG. 1 showing one of the leg supports in the open position and engaging its corresponding leg.

First side 62 and second side 64 of the leg support body intersect to form a leg connection portion 68 that, as shown in FIGS. 7-9, is configured to receive leg portion 38 of leg 14*a* when leg support 16*a* is in the open position. As shown in FIGS. 6 and 10, leg connection portion 68 comprises an arcuate mouth 70 and, preferably, an overmolded piece 72 covers the inner surface of arcuate mouth 70. Overmolded piece 72 may be formed from rubber, plastic, a thermoplastic elastomer (TPE), or any other material that enables overmolded piece 72 to frictionally grip leg portion 38 of leg 14*a*. Leg support 16*a* also includes a catch 74 positioned adjacent leg connection portion 68. Catch 74 is configured to interlock with fastener 60*a* (see FIG. 3) when leg support 16*a* is in the closed storage position, as described below.

Of course, it should be understood that the leg connection portion may have other configurations within the scope of the present invention. For example, the leg connection portion may have a cross-section that is square, rectangular or any other shape, provided that the cross-section of the leg has a complimentary shape to enable the leg connection portion to intimately contact the leg.

Referring to FIG. 10, third side 66 of the leg support body includes two generally planar leaves 76, 78 that extend outwardly therefrom. Leaf 76 includes a set of knuckles 76*a*, 76*b*, 76*c* and, similarly, leaf 78 includes a set of knuckles 78*a*, 78*b*, 78*c*. The interior surfaces of knuckles 76*a*, 76*c*, 78*a*, 78*c* are oriented to face in a first direction and the interior surfaces of knuckles 76*b*, 78*b* are oriented to face in a second opposed direction. As such, a first cylindrical hollow channel is defined by knuckles 76*a*, 76*b*, 76*c* for receiving a first pin 80 and, similarly, a second cylindrical hollow channel is defined by knuckles 78*a*, 78*b*, 78*c* for receiving a second pin 82. Pins 80, 82 are secured to bottom surface 34 of table 18 (see FIG. 3), as described below. As such, third side 66 of the leg support body is hingedly connected to bottom surface 34 of table 18 through the interlocking of knuckles 76*a*, 76*b*, 76*c* with pin 80 and the interlocking of knuckles 78*a*, 78*b*, 78*c* with pin 82. Of course, one skilled in the art will understand that third side 66 of the leg support body may be attached to bottom surface 34 of table 18 via other types of attachment means known in the art, such as any hinged fastener that uses pins or even a Velcro® brand fastener.

Referring to FIG. 3, bottom surface 34 of table 18 includes an interior portion 84 that is slightly recessed relative to an exterior portion 86. As shown in FIG. 8, interior portion 84 includes two rectangle-shaped recesses 84*a*, 84*b* formed therein. Pin 80 is positioned within recess 84*a* and extends between side walls 84*c* and 84*d*. Similarly, pin 82 is positioned within recess 84*b* and extends between side walls 84*e* and 84*f*. As shown in FIG. 10, pin 80 includes an outer knurled end 80*a* that enables secure attachment to side wall 84*c* and, similarly, pin 82 include an outer knurled end 82*a* that enables secure attachment to side wall 84*f*. Leg support 16*a* is movable between an open position and a closed storage position by rotating leg support 16*a* about pins 80, 82.

As best shown in FIGS. 7-8, when leg support 16*a* is in the open position, arcuate mouth 70 with overmolded piece 72 is configured to receive leg portion 38 of leg 14*a*. In this embodiment, arcuate mouth 70 with overmolded piece 72 surrounds over one-half of the circumference of leg portion 38. It can be appreciated that leg support 16*a* functions as a brace to stabilize leg 14*a* during use. In particular, leg support 16*a* provides lateral support that prevents voting booth 10 from swaying or swinging (which is a problem associated with conventional voting booths). The inclusion of overmolded piece 72, while optional, provides additional stability by increasing the coefficient of friction between the contacting surfaces to thereby enable arcuate mouth 70 with overmolded piece 72 to frictionally grip leg portion 38.

Of course, it should be understood that the leg support may have other configurations within the scope of the present invention. For example, the leg support may have a leg support body of any geometry, size and shape provided it includes a portion that can be attached to the bottom surface of the table and a portion that can engage and stabilize the leg.

Leg support 16*a* may be moved to the closed storage position by disengaging arcuate mouth 70 with overmolded piece 72 from leg portion 38, detaching leg 14*a* from bottom surface 34 of table 18 (as discussed above), and rotating leg support 16*a* about pins 80, 82 until the leg support body is generally flush with bottom surface 34 of table 18. As shown in FIG. 3, fastener 60*a* immovably secures leg support 16*a* in the closed storage position by engaging catch 74 (see FIG. 10). As used herein, the term "immovably secure" means that the leg support is secured to the table in such a manner as to substantially prevent movement of the leg support in relation to the table. Fastener 60*a* may be manually actuated to release catch 74 and enable leg support 16*a* to be moved from the closed storage position to the open position, as discussed below.

Figure 11:
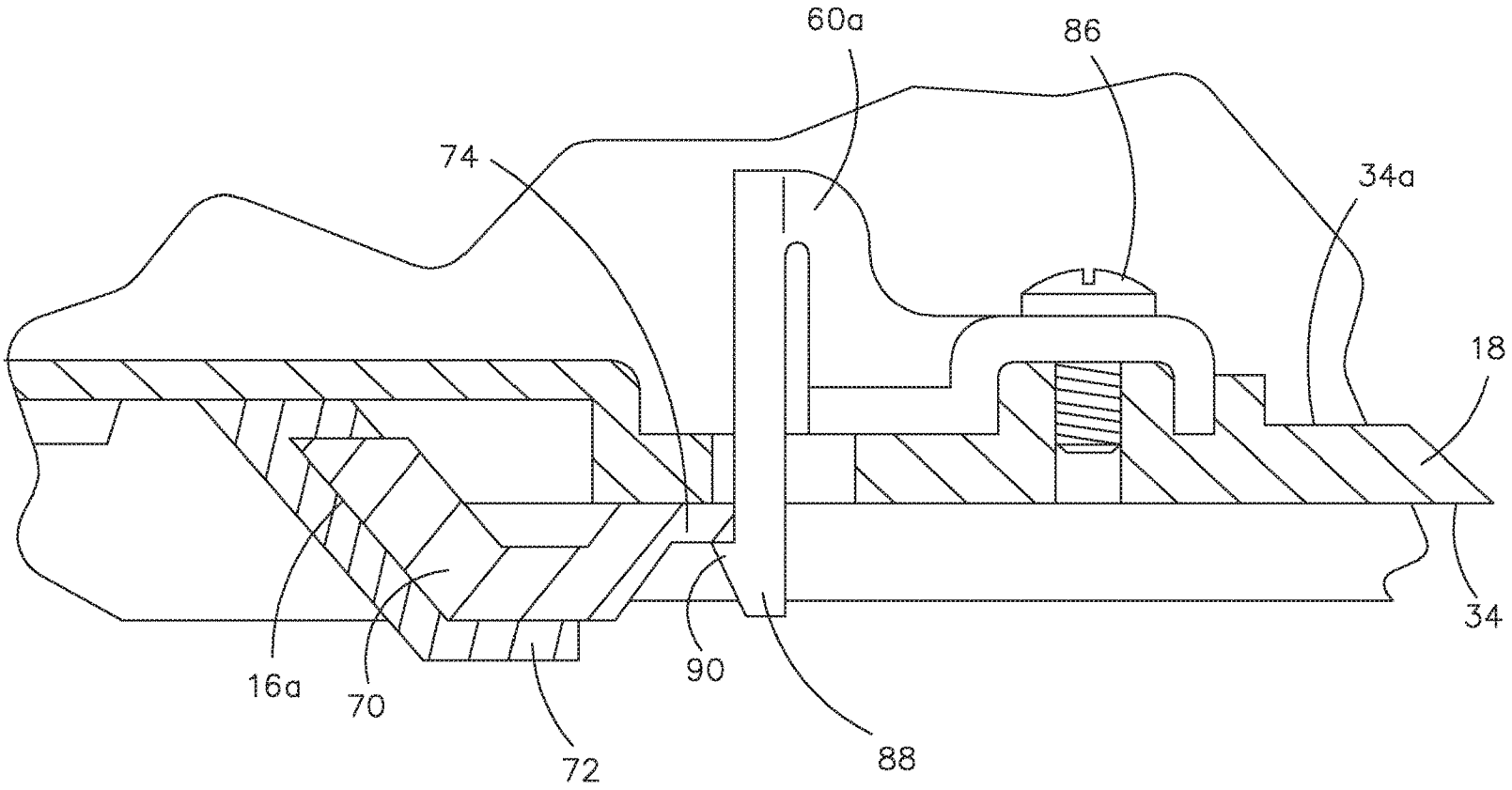
FIG. 11 is a partial cross-sectional side view of the portable voting booth of FIG. 1 showing one of the leg supports in the closed storage position and secured by its corresponding fastener.

Fastener 60*a* is best shown in FIG. 11, which is a partial cross-sectional side view of portable voting booth 10 taken along a line that intersects fastener 60*a* and catch 74 of leg support 16*a*. It should be understood that this view only shows the portion of leg support 16*a* between catch 74 and the inner surface of arcuate mouth 70 with overmolded piece 72 (i.e., first side 62, second side 64, and third side 66 of leg support 16*a* are not seen in this view). Fastener 60*a* comprises a flexible molded snap that is attached with a screw 86 to the backside 34*a* of bottom surface 34 of table 18. Fastener 60*a* includes a tab 88 that extends downwardly from bottom surface 34 of table 18. Tab 88 includes a latch 90 that is positioned to interlock with catch 74 of leg support 16*a* in order to secure leg support 16*a* in the closed storage position.

In order to move leg support 16*a* from the closed storage position to the open position, fastener 60*a* and catch 74 of leg support 16*a* are disengaged by applying force to tab 88 to move or flex latch 90 toward screw 86 so that catch 74 is no longer interlocked with latch 90. The force applied to tab 88 may then be released and leg support 16*a* is rotated about pins 80, 82 to the open position. Conversely, leg support 16*a* may be moved from the open position to the closed storage position by rotating leg support 16*a* about pins 80, 82 to the position generally shown in FIG. 11. It should be understood that manual actuation of tab 88 is not required at this point because catch 74 will move along the sloped edge of tab 88 until fastener 60*a* snaps into the position shown in FIG. 11 in which latch 90 interlocks with catch 74.

It should be understood that the present invention is not limited to the use of leg supports that are secured to the bottom surface of the table using fasteners as described in connection with the first exemplary embodiment. In some embodiments, other types of fasteners known in the art may be used, such as button snaps, magnets, Velcro® brand fasteners, or any other type of clip. In other embodiments, the leg supports may be secured to another portion of the portable voting booth. In yet other embodiments, the leg supports are not movable and are permanently held in an open position, although this configuration is not preferred insofar as the voting booth could not be disassembled to provide a compact unit for storage.

B. Second Exemplary Embodiment

Figure 12:
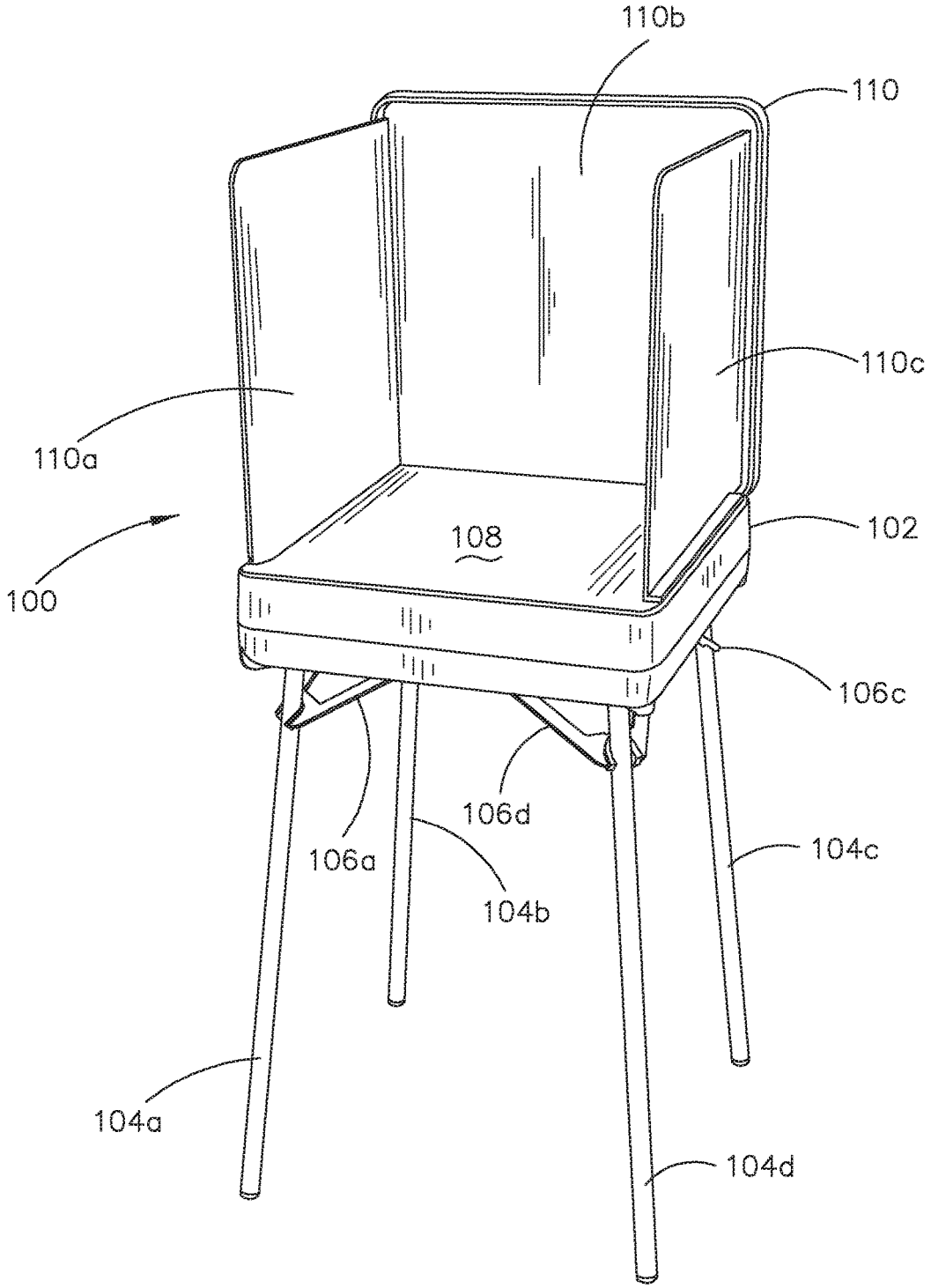
FIG. 12 is a perspective view of a portable voting booth in accordance with a second exemplary embodiment of the present invention, wherein the portable voting booth includes a table that provides a writing surface on which a paper ballot may be hand-marked by a voter and four legs removably attached to the bottom surface of the carrying case that are stabilized by four leg supports.

Referring to FIG. 12, a portable voting booth in accordance with a second exemplary embodiment of the present invention is shown generally as reference numeral 100. In general terms, portable voting booth 100 includes a table 102, four removable legs 104*a*, 104*b*, 104*c*, 104*d* that support table 102 during use, and four leg supports 106*a*, 106*b*, 106*c*, 106*d* (leg support 106*b* is not seen in FIG. 12) that are movable between an open position in which the leg supports stabilize legs 104*a*, 104*b*, 104*c*, 104*d*, respectively, during use and a closed position in which the leg supports are secured to the bottom surface of table 102 for storage.

Table 102 includes a top surface 108 that provides a writing surface on which a paper ballot is hand-marked by a voter. Preferably, a three-panel, foldable privacy screen 110 is included that provides privacy when voters cast their ballots in an election. As can be seen, privacy screen 110 includes a left panel 110*a*, a center panel 110*b* and a right panel 110*c*, which are attached along their bottom edges to top surface 108 of table 102. In this embodiment, panels 110*a*, 110*b*, 110*c* are attached to top surface 108 of table 102 via the use of Velcro® brand tape strips. Of course, other types of temporary or permanent attachment means may also be used. Left and right panels 110*a*, 110*c* may also be modified to comply with the ADA by the addition of privacy screen extensions (not shown), as is well known in the art.

It should be understood that the bottom surface of table 102 is identical to that of table 18 of the first exemplary embodiment and will not be separately described herein. Further, it should be understood that legs 104*a*, 104*b*, 104*c*, 104*d* have the same configuration as legs 14*a*, 14*b*, 14*c*, 14*d* of the first exemplary embodiment and, similarly, leg supports 106*a*, 106*b*, 106*c*, 106*d* have the same configuration as leg supports 16*a*, 16*b*, 16*c*, 16*d* of the first exemplary embodiment. As such, the structure and functionality of each of these components will not be separately described herein.

C. General

The description set forth above provides several embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

The use of any and all examples or exemplary language (e.g., "such as") provided with respect to certain embodiments is intended merely to better describe the invention and does not pose a limitation on the scope of the invention. No language in the description should be construed as indicating any non-claimed element essential to the practice of the invention.

As used herein, unless the context dictates otherwise, the terms "coupled to," "connected to" and "attached to" are intended to include both direct coupling (in which two elements are directly connected to each other) and indirect coupling (in which at least one additional element is located between the two elements).

Also, the recitation of ranges of values herein is merely intended to serve as a shorthand method of referring individually to each separate value falling within the range. Unless otherwise indicated, each individual value is incorporated into the description as if it were individually recited herein.

While the present invention has been described and illustrated hereinabove with reference to several exemplary embodiments, it should be understood that various modifications could be made to these embodiments without departing from the scope of the invention. Therefore, the present invention is not to be limited to the specific structural configurations of the exemplary embodiments, except insofar as such limitations are included in the following claims.

What is claimed and desired to be secured by Letters Patent is as follows:

1. A portable voting booth, comprising:

a table having a top surface and a bottom surface;

a plurality of legs configured to support the table;

a plurality of leg supports attached to the table and movable between an open position and a closed storage position, wherein each of the leg supports comprises a generally planar triangle-shaped body having first, second and third sides, wherein the first and second sides intersect to form a leg connection portion that engages and stabilizes one of the legs when the leg supports are in the open position, wherein the third side is hingedly attached to the table, and wherein the table comprises a plurality of fasteners each of which engages at least a portion of one of the leg supports when the leg supports are in the closed storage position to immovably secure the leg supports to the table.

2. The portable voting booth of claim 1, wherein the table supports an electronic voting machine on the top surface thereof.

3. The portable voting booth of claim 2, wherein the table comprises a lower base of a carrying case for the electronic voting machine.

4. The portable voting booth of claim 1, wherein the top surface of the table provides a writing surface on which a paper ballot is hand-marked by a voter.

5. The portable voting booth of claim 1, wherein the legs are removably attached to the table.

6. The portable voting booth of claim 1, wherein each of the leg supports is attached to the bottom surface of the table.

7. The portable voting booth of claim 1, wherein the leg connection portion comprises a mouth shaped to receive a portion of the one of the legs when the leg supports are in the open position.

8. The portable voting booth of claim 7, wherein the mouth includes an overmolded piece that frictionally grips the one of the legs.

9. The portable voting booth of claim 1, wherein each of the fasteners comprises a latch.

10. The portable voting booth of claim 1, wherein the leg supports are flush with the bottom surface of the table when the leg supports are in the closed storage position.

11. The portable voting booth of claim 1, wherein the leg supports are disengaged from the legs when the leg supports are in the closed storage position.

12. The portable voting booth of claim 1, wherein the table comprises a plurality of pins, wherein the third side of the triangle-shaped body comprises at least one knuckle that extends from at least one leaf, and wherein the knuckle interlocks with one of the pins of the table.

13. A portable voting booth, comprising:

a table having a top surface and a bottom surface, wherein the table comprises a plurality of fasteners;

a plurality of legs removably attached to the table;

a plurality of leg supports attached to the table and movable between an open position and a closed storage position, wherein each of the leg supports comprises a generally planar triangle-shaped body having first, second and third sides, wherein the first and second sides intersect to form a leg connection portion that engages and stabilizes one of the legs when the leg supports are in the open position and the third side is hingedly attached to the table, and wherein each of the fasteners of the table engages at least a portion of one of the leg supports when the leg supports are in the closed storage position to immovably secure the leg supports to the table.

14. The portable voting booth of claim 13, wherein the table supports an electronic voting machine on the top surface thereof.

15. The portable voting booth of claim 14, wherein the table comprises a lower base of a carrying case for the electronic voting machine.

16. The portable voting booth of claim 13, wherein the top surface of the table provides a writing surface on which a paper ballot is hand-marked by a voter.

17. The portable voting booth of claim 13, wherein each of the leg supports is attached to the bottom surface of the table.

18. The portable voting booth of claim 13, wherein the leg connection portion comprises a mouth shaped to receive a portion of the one of the legs when the leg supports are in the open position.

19. The portable voting booth of claim 18, wherein the mouth includes an overmolded piece that frictionally grips the one of the legs.

20. The portable voting booth of claim 13, wherein each of the fasteners comprises a latch.

21. The portable voting booth of claim 13, wherein the fasteners are positioned on the bottom surface of the table.

22. The portable voting booth of claim 13, wherein the leg supports are flush with the bottom surface of the table when the leg supports are in the closed storage position.

23. The portable voting booth of claim 13, wherein the leg supports are disengaged from the legs when the leg supports are in the closed storage position.

24. The portable voting booth of claim 13, wherein each of the leg supports is attached to the table via a hinge.

25. The portable voting booth of claim 13, wherein the table comprises a plurality of pins, wherein the third side of the triangle-shaped body comprises at least one knuckle that extends from at least one leaf, and wherein the knuckle interlocks with one of the pins of the table.

26. The portable voting booth of claim 1, further comprising:

a privacy screen attached to the table and configured to provide voter privacy.

27. The portable voting booth of claim 26, wherein the table supports an electronic voting machine on the top surface thereof.

28. The portable voting booth of claim 27, wherein the electronic voting machine is secured within a carrying case comprising a lower base and a cover, wherein the table comprises the lower base of the carrying case when in an open position.

29. The portable voting booth of claim 28, wherein the privacy screen comprises a left panel, a right panel, and the cover of the carrying case when in the open position.

30. The portable voting booth of claim 26, wherein the top surface of the table provides a writing surface on which a paper ballot is hand-marked by a voter.

31. The portable voting booth of claim 30, wherein the privacy screen comprises a left panel, a right panel, and a center panel.

32. The portable voting booth of claim 26, wherein the legs are removably attached to the table.

33. The portable voting booth of claim 26, wherein the leg connection portion comprises a mouth shaped to receive a portion of the one of the legs.

34. The portable voting booth of claim 33, wherein the mouth includes an overmolded piece that frictionally grips the one of the legs.

* * * * *